US011105504B2

(12) United States Patent
Babington et al.

(10) Patent No.: US 11,105,504 B2
(45) Date of Patent: Aug. 31, 2021

(54) ATOMIZATION BURNER WITH FLEXIBLE FIRE RATE

(71) Applicant: Babington Technology, Inc., Rocky Mount, NC (US)

(72) Inventors: Andrew D. Babington, Potomac Hills, VA (US); Juan Carlos Lemus, Rocky Mount, NC (US); Nigel Jones, Frederick, MD (US); Robert L. Babington, Fairfax, VA (US); Robert S. Babington, McLean, VA (US)

(73) Assignee: Babington Technology, Inc., Rocky Mount, NC (US)

( * ) Notice: Subject to any disclaimer, the term of this patent is extended or adjusted under 35 U.S.C. 154(b) by 94 days.

(21) Appl. No.: 16/396,082

(22) Filed: Apr. 26, 2019

(65) Prior Publication Data

US 2019/0249867 A1 Aug. 15, 2019

Related U.S. Application Data

(63) Continuation of application No. 15/405,685, filed on Jan. 13, 2017, now Pat. No. 10,302,299.
(Continued)

(51) Int. Cl.
*F23D 11/00* (2006.01)
*F23D 11/10* (2006.01)

(52) U.S. Cl.
CPC ..... *F23D 11/001* (2013.01); *F23D 11/10* (2013.01); *F23D 2200/00* (2013.01);
(Continued)

(58) Field of Classification Search
CPC .... F23D 11/001; F23D 11/10; F23D 2200/00; F23D 2202/00; F23D 2027/06;
(Continued)

(56) References Cited

U.S. PATENT DOCUMENTS 1,872,907 A * 8/1932 Doherty ..... F23K 5/02 431/9
1,986,201 A 1/1935 Huff
(Continued)

FOREIGN PATENT DOCUMENTS

CN 204165050 U * 2/2015
CN 204165050 U 2/2015
(Continued)

OTHER PUBLICATIONS

"CN_204165050_U_M—Machine Translation.pdf", machine translation, EPO.org, Jul. 30, 2020.*
(Continued)

*Primary Examiner* — Steven B McAllister
*Assistant Examiner* — Daniel E. Namay
(74) *Attorney, Agent, or Firm* — Polsinelli PC

(57) ABSTRACT

An atomizing burner and corresponding method for turning an atomizing burner from an ON state to an OFF state. The burner has independently controllable flows of atomizing air, combustion air, and fuel flow, the burner in the ON state having flow values of burner parameters including flow of atomizing air, flow of combustion air, and fuel flow. The method includes: changing, in response to an OFF instruction, flow of at least one of the flow of atomizing air, combustion air and/or fuel to a lower non-zero value; first discontinuing, after a first period of time since the changing, flow of fuel and flow of atomizing air; maintaining, for a second period of time since the first period of time, flow of combustion air; second discontinuing, after the maintaining, flow of combustion air; wherein the maintaining prevents buildup of excess heat inside the burner during the transition to the OFF state.

14 Claims, 13 Drawing Sheets

Related U.S. Application Data

(60) Provisional application No. 62/278,163, filed on Jan. 13, 2016.

(52) U.S. Cl.
CPC .... *F23D 2202/00* (2013.01); *F23D 2208/005* (2013.01); *F23N 2227/06* (2020.01)

(58) Field of Classification Search
CPC ..... F23D 11/446; F23D 11/46; F23N 1/022; F23N 2227/02; F23N 2227/06
USPC ..... 431/6, 12, 2, 354
IPC ..... F23D 11/10,1/02
See application file for complete search history.

(56) References Cited

U.S. PATENT DOCUMENTS 4,358,266 A * 11/1982 Pont ..... F23D 11/10 239/412
4,380,146 A * 4/1983 Yannone ..... F02C 9/26 60/39.281
4,915,615 A * 4/1990 Kawamura ..... B60H 1/2206 431/41
7,025,810 B2 * 4/2006 Crawley ..... F01N 3/025 431/6
7,104,070 B2 * 9/2006 Iasillo ..... F02C 3/22 60/740
8,099,940 B2 * 1/2012 Twardochleb ..... F23R 3/36 60/39.094
8,215,949 B2 * 7/2012 Toqan ..... F23J 7/00 431/4
8,845,323 B2 * 9/2014 Johnson ..... F23N 5/242 431/72
9,657,938 B2 * 5/2017 Frenette ..... F23D 11/24
10,302,299 B2 * 5/2019 Babington ..... F23D 11/10
2006/0068347 A1 * 3/2006 Li ..... F23N 5/082 431/12
2012/0315586 A1 * 12/2012 Gard ..... F23D 11/38 431/11
2014/0113238 A1 4/2014 Kiarostami et al.
2016/0138802 A1 * 5/2016 Babington ..... F23D 11/40 431/352
2017/0198903 A1 * 7/2017 Babington ..... F23D 11/001
2019/0249867 A1 * 8/2019 Babington ..... F23D 11/001
2020/0096195 A1 * 3/2020 Babington ..... F23N 3/005

FOREIGN PATENT DOCUMENTS

EP 1500878 A2 * 1/2005 ..... F23N 1/022
EP 1500878 A2 1/2005
JP 63194126 A * 8/1988 ..... F23N 5/242
JP 2007322093 A * 12/2007

OTHER PUBLICATIONS

"EP_1500878_A2_M—Machine Translation.pdf", machine translation, EPO.org, Jul. 30, 2020.*
European Search Report dated Sep. 26, 2019 in European Patent Application No. 17 73 9013 (4 pages).
Office Action dated May 28, 2019 issued in corresponding Chinese Application No. 201780017301. 7 (15 pages).

* cited by examiner

ATOMIZATION BURNER WITH FLEXIBLE FIRE RATE

CROSS REFERENCE TO RELATED APPLICATIONS

The instant application is a continuation of, and claims priority to, U.S. patent application Ser. No. 15/405,685 entitled ATOMIZATION BURNER WITH FLEXIBLE FIRE RATE filed Jan. 13, 2017, which claims priority to U.S. Provisional Application 62/278,163, entitled ATOMIZATION BURNER WITH FLEXIBLE FIRE RATE, filed on Jan. 13, 2016, the contents of which are incorporated by reference herein in their entireties.

FIELD OF THE INVENTION

Various embodiments described herein relate generally to control of operating characteristics of a burner. More specifically, various embodiments described herein relate to an adjustable atomizing burner that can vary its output heat of a burner by dynamically adjusting the flows of fuel, combustion air and atomizing air during continuous operation.

BACKGROUND

Fuel burners built consistent with the Babington atomization principle are well known. The methodology mimics the atomization of water over a blowhole of a whale when the whale exhales. In the burner, a thin layer of fuel is poured over a convex surface that has a tiny air hole. Pressurized clean air is forced through the hole, creating a spray so fine that when burned, it creates no smoke, odor or carbon monoxide. By way of non-limiting example, the AIRTRONIC series of burners by BABINGTON TECHNOLOGY operate on this principle. Non-limiting examples of patents that disclose burners built according to this principle include, e.g., U.S. Pat. No. 4,298,338 entitled LIQUID FUEL BURNERS, U.S. Pat. No. 4,507,076 entitled ATOMIZATION APPARATUS AND METHOD FOR LIQUID FUEL BURNERS AND LIQUID ATOMIZERS, or U.S. Pat. No. 8,622,737 entitled PERFORATED FLAME TUBE FOR A LIQUID FUEL BURNER, the contents of which are incorporated herein by reference in their entireties, may be used.

Referring to FIG. 11, an exploded view of the AIRTRONIC burner 1100 is shown. The burner includes a double shafted AC motor 1102 with a fixed speed. AC motor 1102 collectively drives a fuel pump 1104, an atomizing air compressor 1106, and a combustion air blower 1108. Fuel pump 1104 delivers a stream of fuel from a reservoir 1110 to a point above convex heads (not shown) of an atomizing chamber 1111. Air compressor 1106 injects air through a small hole in the heads spraying fuel as it flows over the hole of heads and projects the atomized fuel into flame tube 1116 (a process known as "atomization," thus air compressor 1106 being an "atomizing" air compressor). An ignitor (not shown) ignites the atomized fuel. Combustion air blower 1108 delivers a flow of air to the flame tube 1116 that combusts with the fuel to provide flame and heat, and to carry the heat and combusting fuel out of the flame tube 1116.

In an atomization burner the flow of compressed air, combustion air and fuel must maintain a certain mixture relationship in order to properly combust the fuel. For example, a particular flow of atomizing air can only function with a certain range of fuel flow. Fuel flow in excess of that range is too thick to properly atomize, while fuel flow below that range is so thin that particles are too small to properly combust. Fuel flow above or below that range simply will not combust and/or will sub-optimally combust and generate byproducts (e.g., smoke, odor).

By nature of its design, the AIRTRONIC has constrained flexibility relative to this relationship. The fixed speed of the single AC motor 1102 drives fuel pump 1104, combustion air blower 1108, and atomizing air compressor 1106 at corresponding fixed maximum speeds. The flow of air from the compressor 1106 to atomizer heads (not shown) is not adjustable, which limits the potential range of fuel flow rate as noted above. The flow rate of fuel from fuel pump 1104 has some flexibility to reduce the fuel flow via an adjustable mechanical restrictor in the fuel flow pathway, but this is only accessible at the point of manufacture and is not adjustable by the consumer (absent disassembly). The flow of combustion air has some greater degree of flexibility, and is manually adjustable via a knob 1109 to physically restrict the air pathway from combustion air blower 1108 to flame tube 116. This design combust fuel at a rate of 0.45-0.55 gallons per hour ("GPH"), although approximately 0.4-0.6 GPH is the theoretical range limit.

In recent years a market has emerged for portable cooking and heating appliances to cook for significant numbers of people at locations that do not have access to working kitchen facilities. For example, disaster relief operations need transportable kitchen appliances to bring to disaster zones and relief centers. Military units need kitchen appliances to support operations as personnel are deployed and relocate base camp. Restaurants and caterers may wish to cook at remote locations, such as beaches, wooded areas, street fairs, etc. A need therefore exists for portable and/or mobile kitchen appliances.

A difficulty with portable and/or mobile kitchen appliances is that it can be difficult to obtain different types of fuel in such circumstances as well as operate on reliable and sufficient electrical power. For example, if the transporting vehicle runs on gasoline and the cooking appliances run off propane, then there is a need to store, transport and maintain a supply of two different fuels. Gasoline and propane are also volatile fuels and dangerous to transport and store in the field. Organizations that provide such services therefore prefer that kitchen appliances and the vehicles that transport them consume the same type of fuel. Liquid distillate fuel, such as diesel as burned by the AIRTRONIC, is preferred. Applicants have several patents and applications to utilize a burner such as the AIRTRONIC in connection with portable cooking appliances, such as U.S. Pat. No. 8,499,755 entitled MOBILE KITCHEN, U.S. Pat. No. 7,798,138 entitled CONVECTION OVEN INDIRECTLY HEATED BY A FUEL BURNER, the contents of which are incorporated by reference herein in their entireties.

Use of the AIRTRONIC with portable cooking and/or heating appliances has a variety of drawbacks.

One drawback is that even at its minimal fuel flow rate the AIRTRONIC produces more heat than necessary for particular cooking apparatus. Some cooking appliances need to be overbuilt to withstand this heat output, which makes the appliance expensive to manufacture, heavy and energy inefficient. By way of non-limiting example, an oven as shown in U.S. Pat. No. 7,798,138 that could withstand the heat output of the AIRTRONIC weighs on the order of 800 lbs., which limits its portability options.

It is also difficult to change the temperature of the appliance. The overbuilt nature of the appliance needed to withstand the excessive heat output has a corresponding large specific heat, which makes the appliance slow to heat (wasting time and fuel) and slow to cool (potentially overcooking food). By way of non-limiting example, a chef may want to instantaneously reduce a stockpot cooker from a HIGH setting (e.g., to boil) to LOW setting (e.g., to simmer), but this takes several minutes even if the burner is turned off because the stockpot cooker itself has a high specific heat that retains the original high heat from the HIGH setting and only slowly cools.

It is also difficult to control the appliance temperature. The AIRTRONIC controls heat output via the "bang-bang" methodology, in that it is turned ON or OFF as appropriate to reach/maintain a desired temperature, also known as duty cycling. However, the AIRTRONIC takes 20-30 seconds to turn ON, and 90-120 seconds to turn OFF. By way of non-limiting example, in an oven preheated to 400 degrees, even if the burner is turned OFF when the oven reaches 400 degrees the burner continues to output heat. The oven will thus overshoot its preheat target to a higher temperature, and the specific heat of the appliance will slow the transition from the higher temperature to the desired preheat temperature.

The AIRTRONIC also consumes a considerable amount of power to operate because when active the components are at maximum flow speeds. Any adjustment in flow rates as noted above is due to physical impediments from restrictors in the flow pathways which can reduce flow but do not reduce power consumption. This level of power consumption is undesirable given the limited availability of power in the environments that would utilize portable cooking appliances.

DRAWINGS

Various embodiments in accordance with the present disclosure will be described with reference to the drawings, in which.

DETAILED DESCRIPTION

In the following description, various embodiments will be illustrated by way of example and not by way of limitation in the figures of the accompanying drawings. References to various embodiments in this disclosure are not necessarily to the same embodiment, and such references mean at least one. While specific implementations and other details are discussed, it is to be understood that this is done for illustrative purposes only. A person skilled in the relevant art will recognize that other components and configurations may be used without departing from the scope and spirit of the claimed subject matter.

Several definitions that apply throughout this disclosure will now be presented. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized means "including, but not necessarily limited to"; it specifically indicates open-ended inclusion or membership in the so-described combination, group, series and the like. The term "a" means "one or more" unless the context clearly indicates a single element. The term "about" when used in connection with a numerical value means a variation consistent with the range of error in equipment used to measure the values, for which ±5% may be expected. "First," "second," etc., are labels to distinguish components or steps of otherwise similar names, but does not imply any sequence or numerical limitation.

As used herein, the term "front", "rear", "left," "right," "top" and "bottom" or other terms of direction, orientation, and/or relative position are used for explanation and convenience to refer to certain features of this disclosure. However, these terms are not absolute, and should not be construed as limiting this disclosure.

Shapes as described herein are not considered absolute. As is known in the burner art, surfaces often have waves, protrusions, holes, recess, etc. to provide rigidity, strength and functionality. All recitations of shape (e.g., cylindrical) herein are to be considered modified by "substantially" regardless of whether expressly stated in the disclosure or claims, and specifically accounts for variations in the art as noted above.

Figure 1:
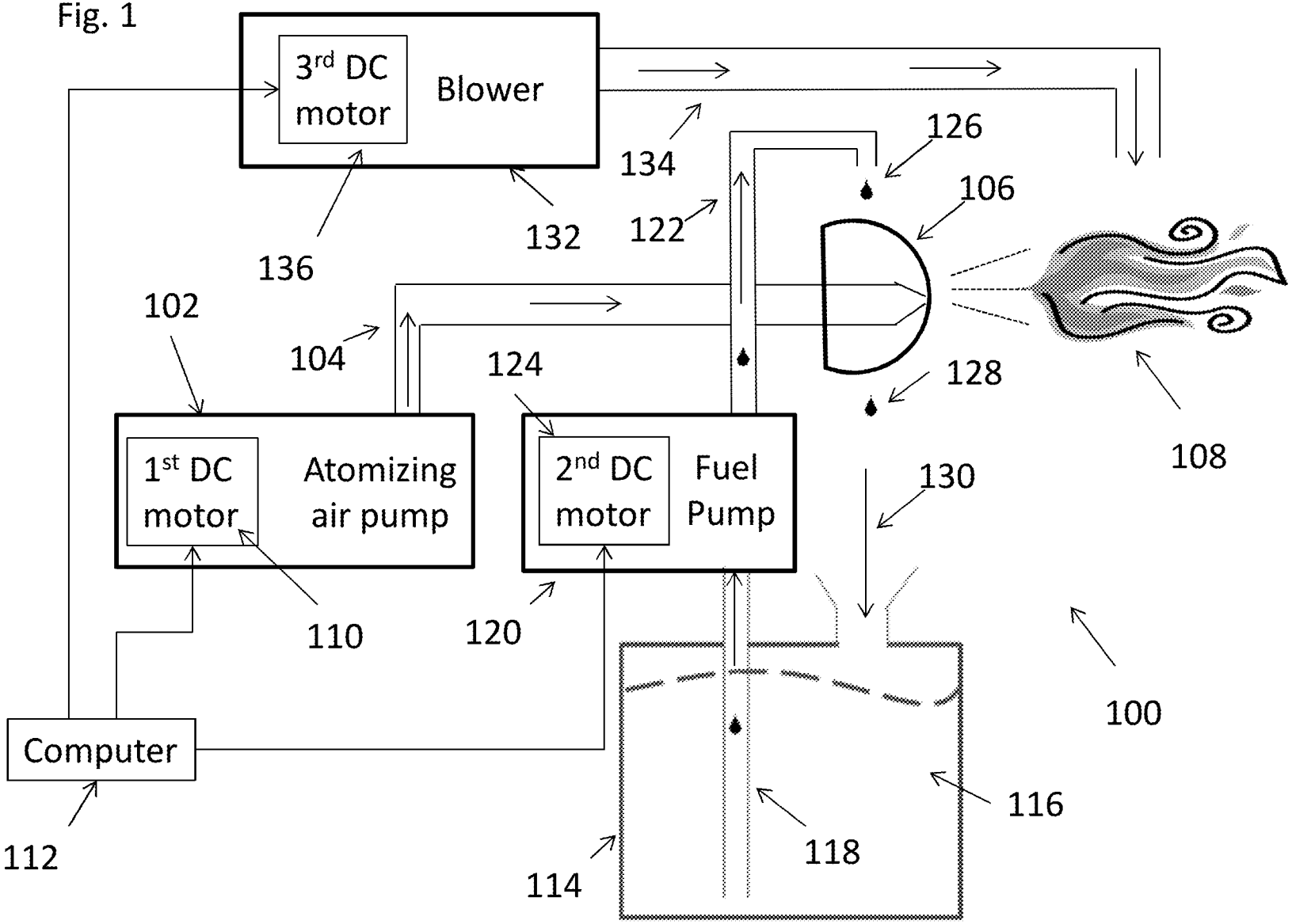
FIG. 1 shows an embodiment of the invention.

Referring now to FIG. 1, a conceptual drawing of a burner 100 according to an embodiment of the invention is shown. Various components are connected by various pathways which can communicate air and/or liquid, such that all pathways are to be considered fluid pathways. It is to be understood for purposes of the conceptual nature of FIG. 1 that each "pathway" refers generically to a path by which a fluid moves from one point to of burner 100 to another, and does not imply any structure or location of the pathway; pathway may not even be a structure at all, as it may simply refer to the path travelled by fluid under gravity.

An atomizing air pump 102, such as an air compressor, is provided to deliver clean air along a pathway 104 to an atomizing chamber supporting at least one atomizing head 106. Atomizing head 106 has a convex surface with an orifice for spray dispensing fuel consistent with the Babington atomization principle. When fuel is poured over atomizing head 106 (as described below) and ignited, the combusting fuel will generate a flame plume 108 laterally in a flame tube (not shown in FIG. 1). Atomizing air pump 102 includes a first adjustable speed DC motor 110, which is controlled by a microcomputer 112. Microcomputer 112 thus controls the flow speed of atomizing air provided by atomizing air pump 102.

A fuel tank 114 is provided with fuel 116 for burner 100, and is preferably located such that the top surface of fuel 116 is below atomizing head 106. An inlet pathway 118 extends from fuel tank 114 to fuel pump 120, and an outlet pathway 122 extends from fuel pump 120 to a point above atomizing head 106. Fuel pump 120 includes a second speed adjustable DC motor 124, which is controlled by microcomputer 112.

Microcomputer 112 thus controls the rate of fuel flow 126 delivered from fuel tank 114 to atomizing head 106.

As is known in the art, the amount of fuel 126 delivered to atomizing head 106 may exceed the amount that is actually ignited by burner 100. Excess fuel 128 falls by gravity along a return pathway 130 which directs the excess fuel 128 back into fuel tank 114.

A blower 132 is provided to deliver clean air for combustion along a pathway 134 to the area in front of and around atomizing head 106, preferably through the interior of the flame tube (not shown). Blower 132 includes a third speed adjustable DC motor 136, which is controlled by microcomputer 112. Microcomputer 112 thus controls the rate of combustion air to feed flame plume 108.

The conceptual design of FIG. 1 may be implemented using various known structures for the components. The various fluid pathways may be constructed from hoses, pipes, or segments thereof connected together in a known manner. In the alternative, the various pathways could be drilled through solid material, such as a steel block. In yet another alternative, the various pathways could be partially defined in opposing blocks that form the pathways when the blocks are connected together. Combinations of the above, as well as other connection forming techniques may be used.

Figure 2:
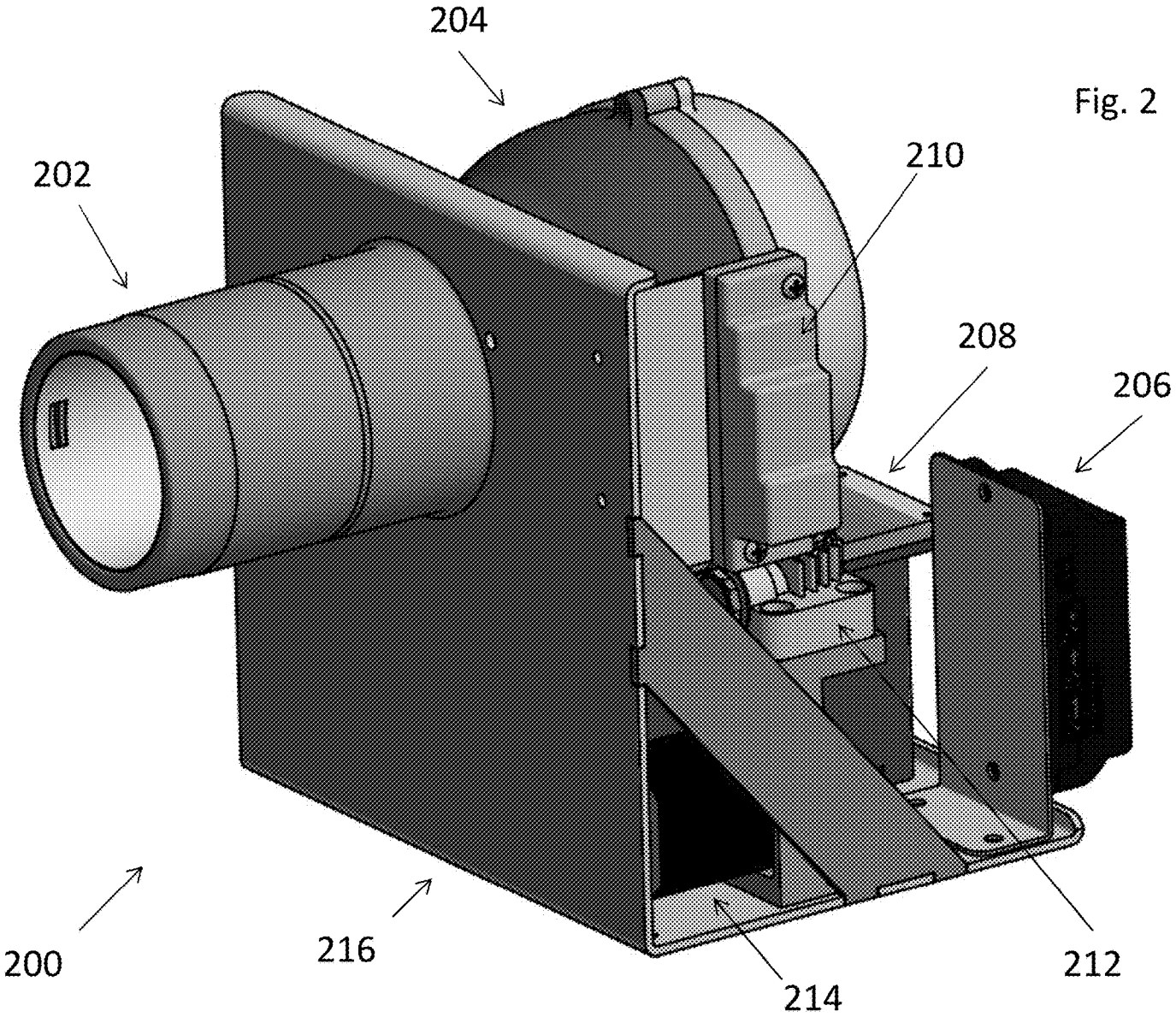
FIG. 2 shows an embodiment of the invention inside of a burner.
Figure 3:
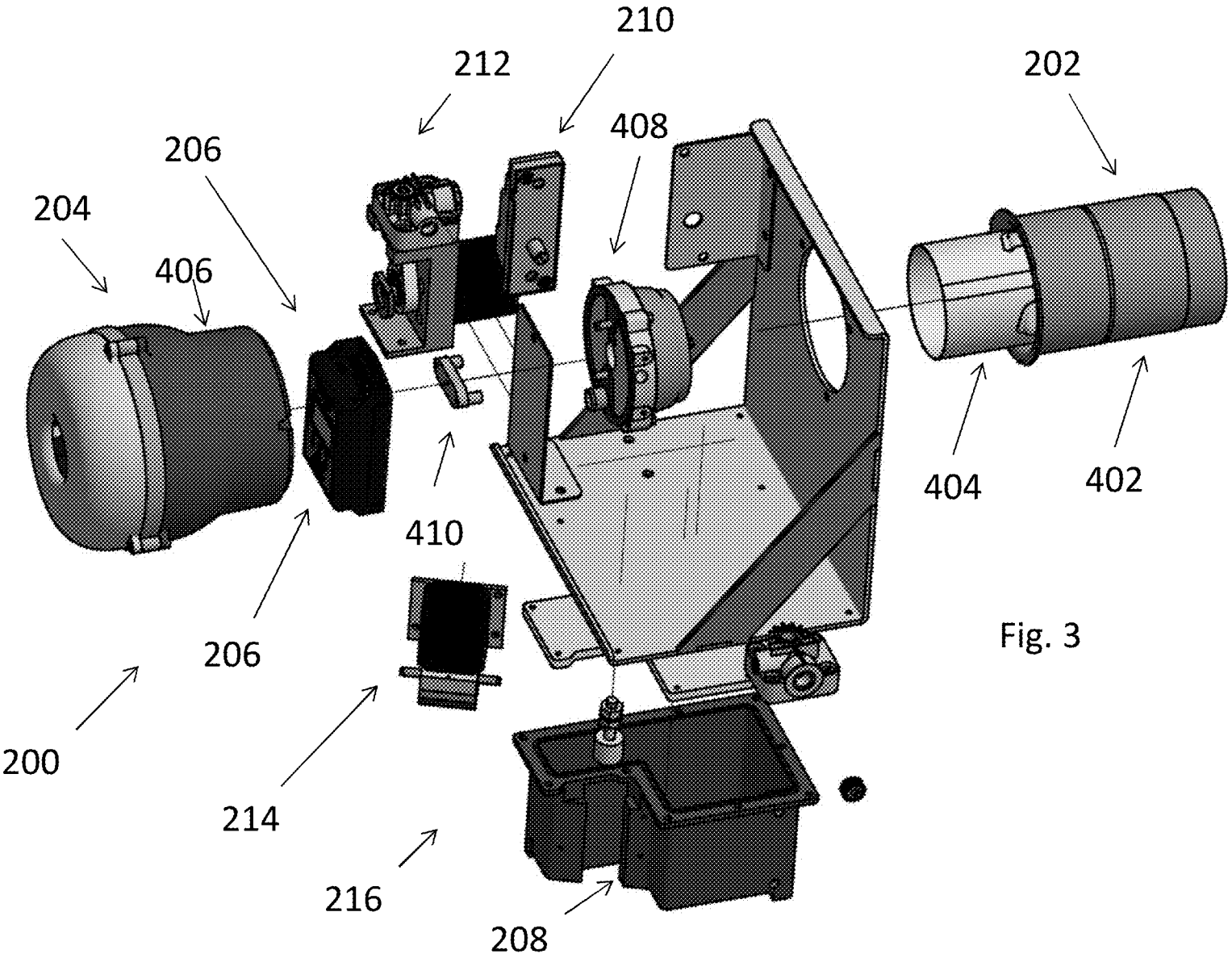
FIG. 3 is an exploded view of the embodiment of FIG. 2.

Referring now to FIGS. 2 and 3, and non-limiting example of an embodiment of a burner 200 consistent with the concept of FIG. 1 is shown. Burner 200 includes a tube assembly 202, a blower 204, a microcomputer 206, a fuel reservoir 208, an ignition transformer 210, an atomizing air compressor 212, and a fuel metered pump 214. The various components are supported by a housing 216. Components are connected and mounted in manners known in the burner art and not further discussed herein.

Figure 4:
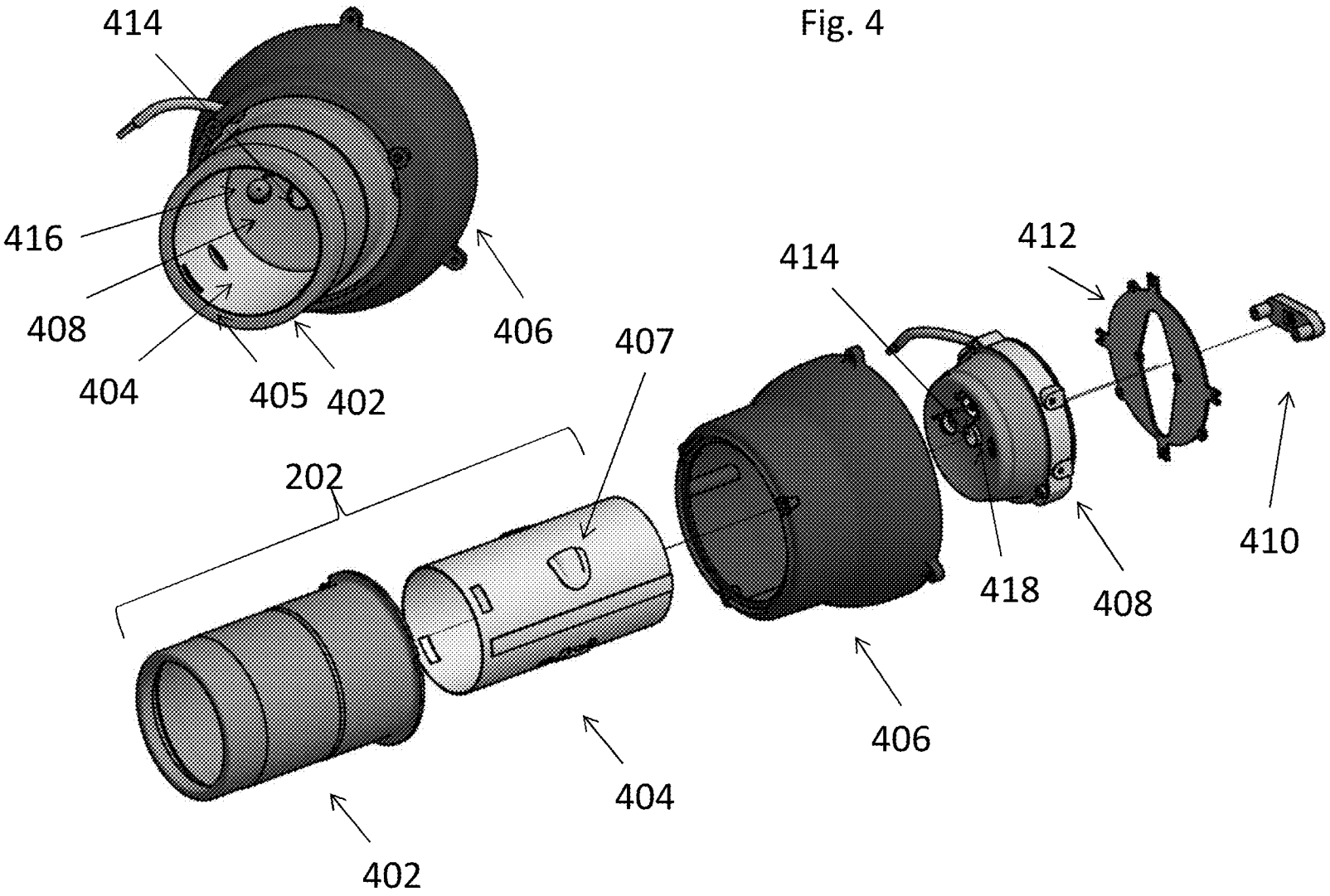
FIG. 4 shows the atomizing chamber and flame tube of FIG. 2.

Referring now to FIGS. 3 and 4, the combustion chamber components of burner 200 are described in more detail. A tube assembly 202 includes an outer air tube 402, an inner flame tube 404, and an end cap 405. Blower 204 blows combustion air into the gap between inner flame tube 404 and outer air tube 402. Various air louvers 407 are provided in inner flame tube 404 to inject air in order to create a swirling combustion process inside inner flame tube 404. Perforated air pathways (not shown) may be provided on the end cap 405 to permit passage of combustion air to cool flame tube assembly 202 and/or to shape combusting fuel as it emerges from the air tube flame tube assembly. The mechanics of the role of the combustion air and non-limiting examples of hole/louver placement are found in U.S. Pat. No. 8,622,737 entitled PERFORATED FLAME TUBE FOR A LIQUID FUEL BURNER, the contents of which is incorporated by reference in its entirety. However, the invention is not so limited, and any number or displacement of holes could be used to introduce air in the inner flame tube 404.

Figure 5:
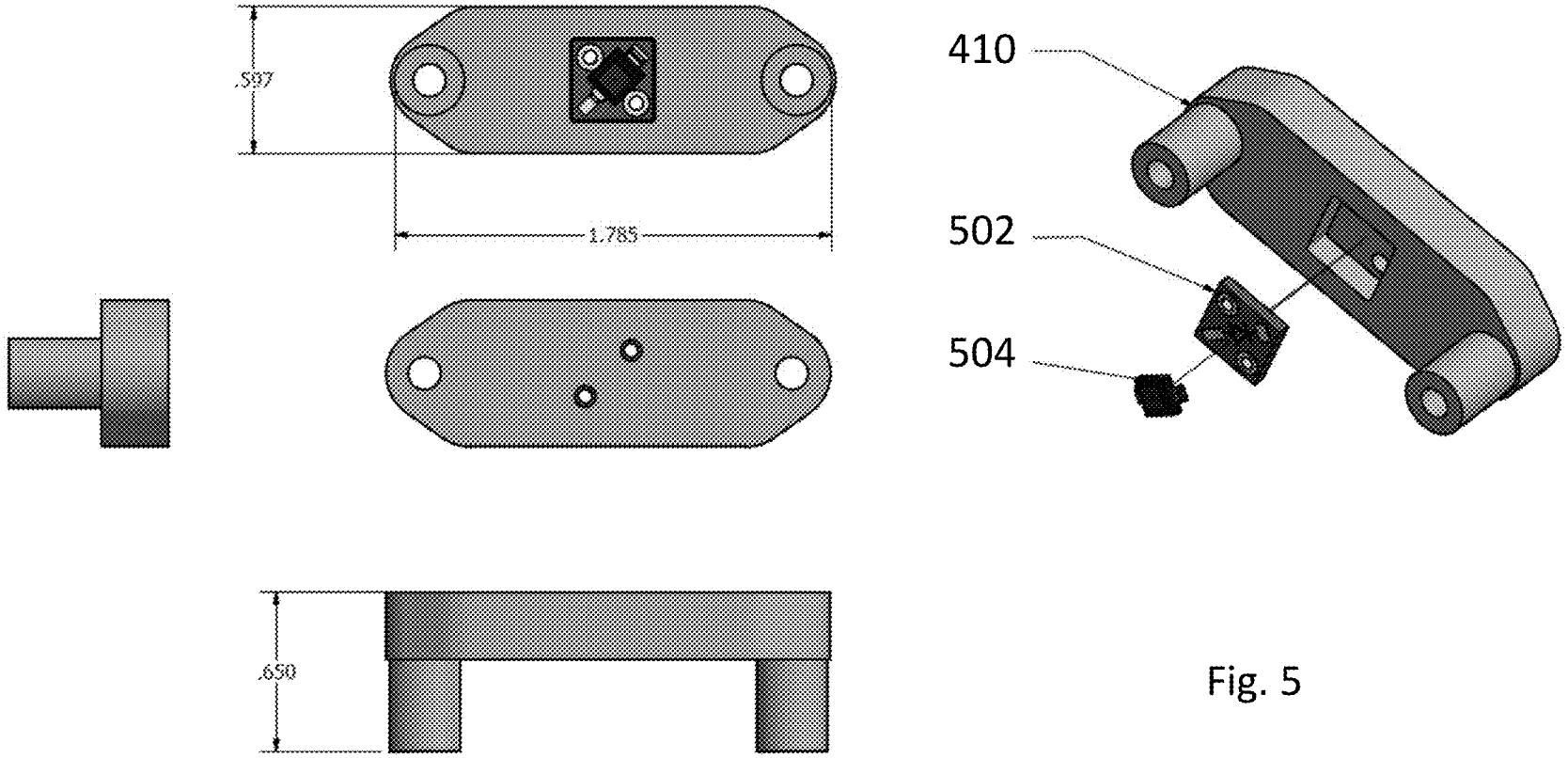
FIG. 5 shows the support and photodiode of FIG. 2.

An atomizing chamber 408 is rearward of the flame tube 404, and receives fuel from fuel reservoir 208 (pathway not shown). A mounting ring 412 is mounted on the rear of atomizing chamber 408. A support 410 is mounted in rearward of ring 412, and supports a photodiode 504 (FIG. 5). Atomizing chamber 408 includes an aperture 414 substantially at the center thereof, through which light from within the inner flame tube 404 can reach photodiode 504. Atomizing heads as known in the art (e.g., head 106 in FIG. 1) are rearward of lateral holes 418. A front casing 406 (which is part of the blower 204) has a flange that engages with the rear of outer air tube 402. However, the invention is not so limited, and other forms of atomizing chambers may be used.

Referring now to FIG. 5, the support 410 is shown in more detail. Support 410 supports a circuit board 502, which in turn supports photodiode 504. Photodiode 504 is part of a flame detection device described in more detail in U.S. Provisional Patent Application 62/274,879 discussed above. However, the invention is not so limited, and other forms and/or locations of flame detection could be used.

Figure 6:
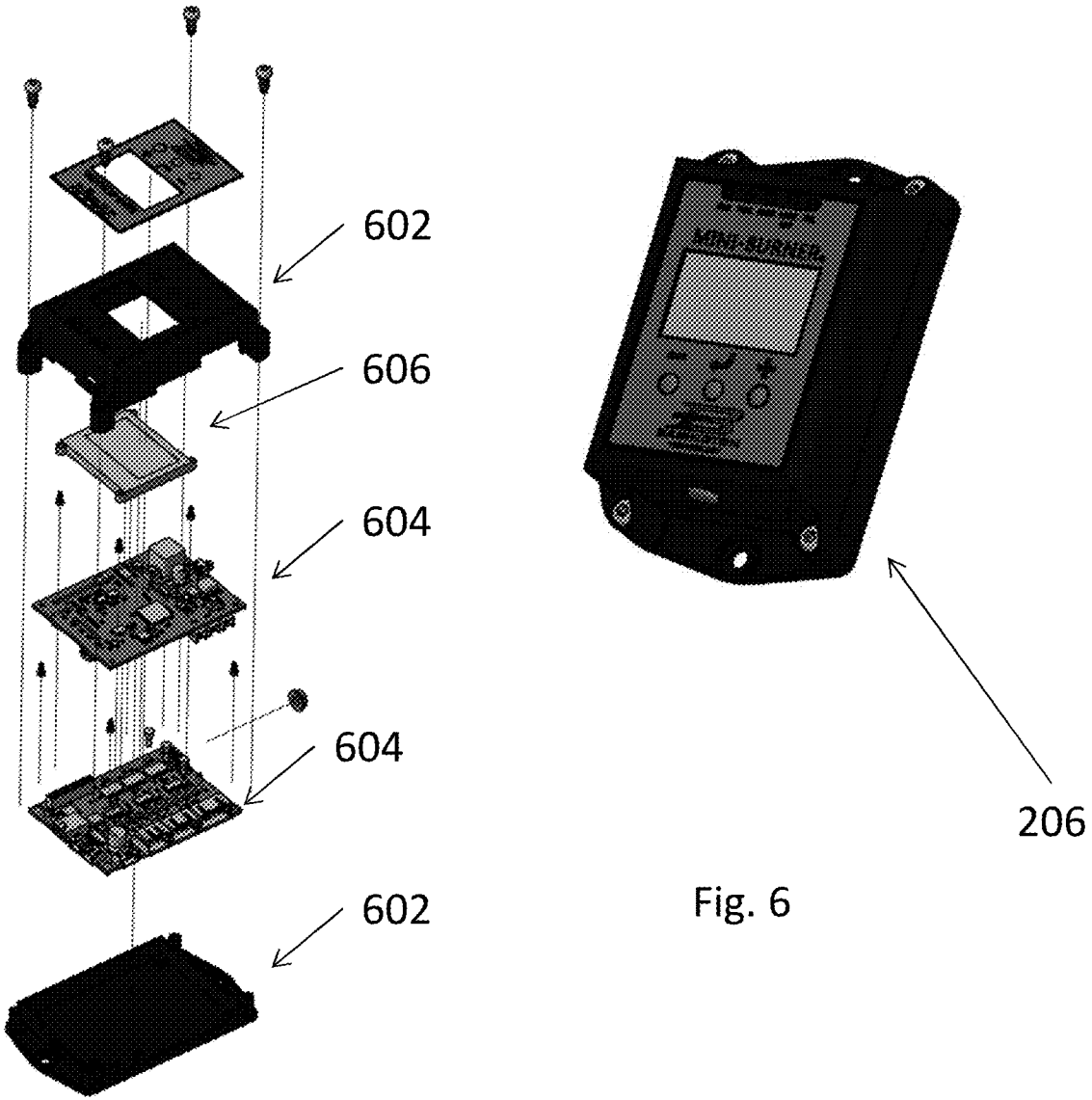
FIG. 6 shows the microcomputer of FIG. 2.

Referring now to FIG. 6, microcomputer 206 is shown in more detail. From hardware perspective, microcomputer 206 includes housing components 602, circuit board components 604, and display 606. The circuit board components includes standard computer components such as at least one interface, display, processor, memory, wireless modem, jack for wired modem, etc. as is well known in the art and not discussed further herein. Microcomputer 206 also includes software and/or stored data to control the operation of burner 200 as discussed further herein. Software may be periodically updated to allow for new control protocols. The invention is not limited to the particulars of the implementation of microcomputer 206, and the functionality therein may be in one unit as shown, multiple units, and/or work in cooperation with an external computer.

Figure 7:
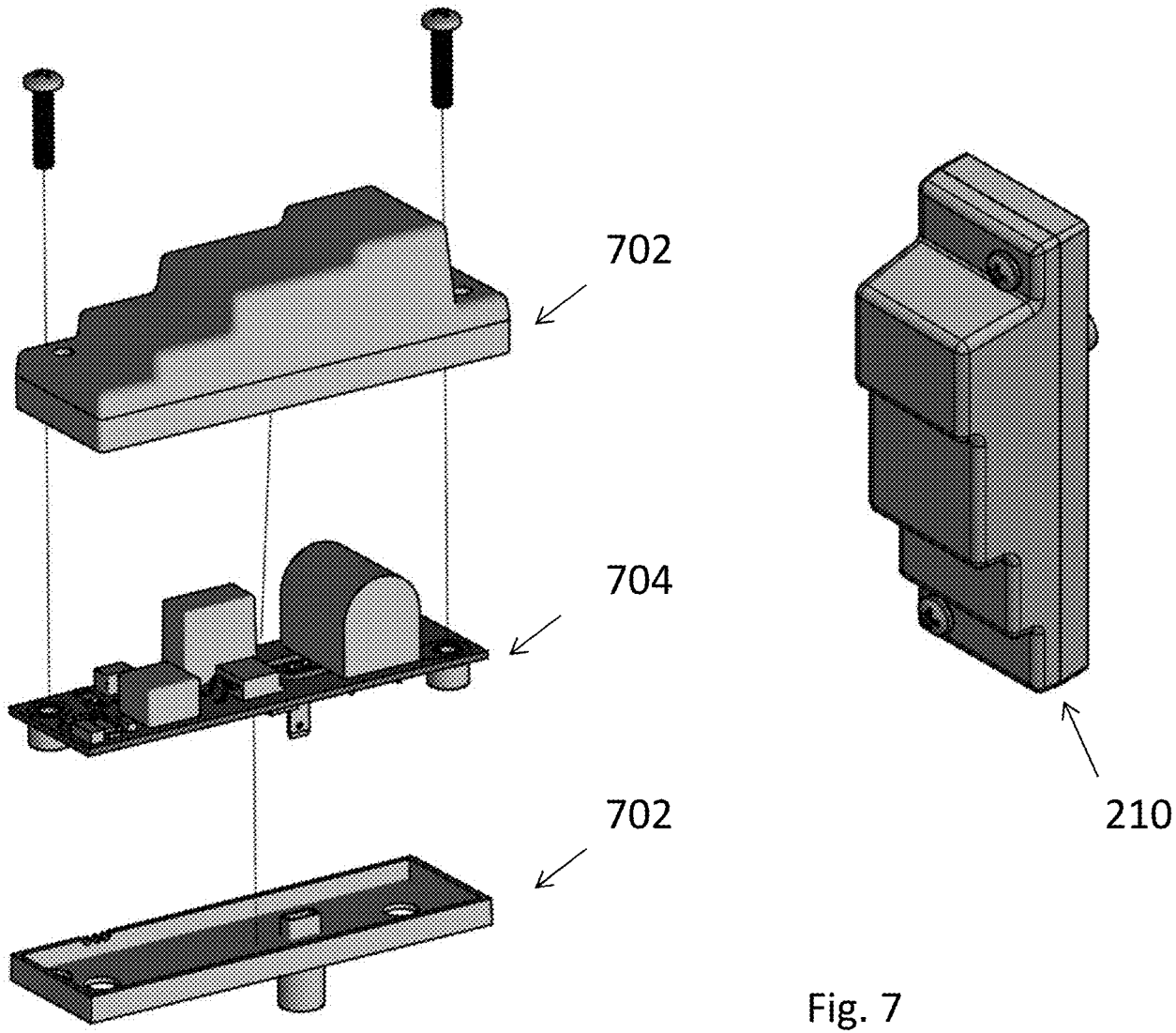
FIG. 7 shows the ignitor transformer of FIG. 2.

Referring now to FIG. 7, ignition transformer 210 is shown in more detail. Ignition transformer 210 includes housing components 702 and a printed circuit board 704. As is known in the burner art, ignition transformer 210 converts available external power (AC or DC, not shown) into the power to generate a spark that it provides to electrodes (not shown) in atomizing chamber 408. However, the invention is not so limited, and other forms of ignitors may be used.

Figure 8:
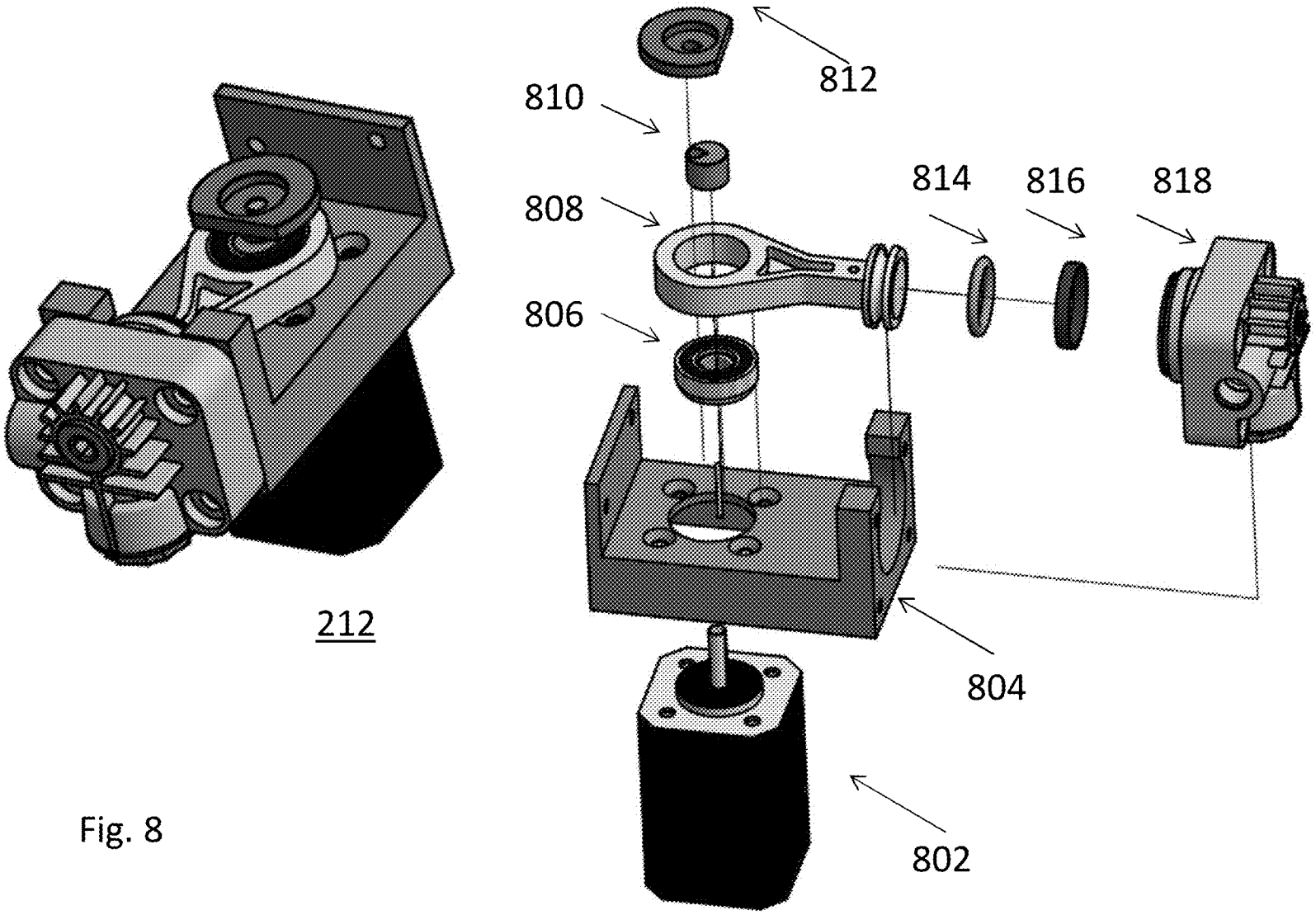
FIG. 8 shows the compressor of FIG. 2.

Referring now to FIG. 8, atomizing air pump 212 is shown in more detail. Atomizing air pump 212 includes a DC motor 802 below a frame 804, a bearing 806, a piston 808, a piston bushing 810, a counterweight 812, an O-ring 814, a piston ring 816, and a compressor cylinder head 818. However, the invention is not so limited, and other forms of atomizing air pumps may be used. DC motor 802 drives piston 808 to provide clean air to the holes in atomizing heads to spray fuel.

Figure 9:
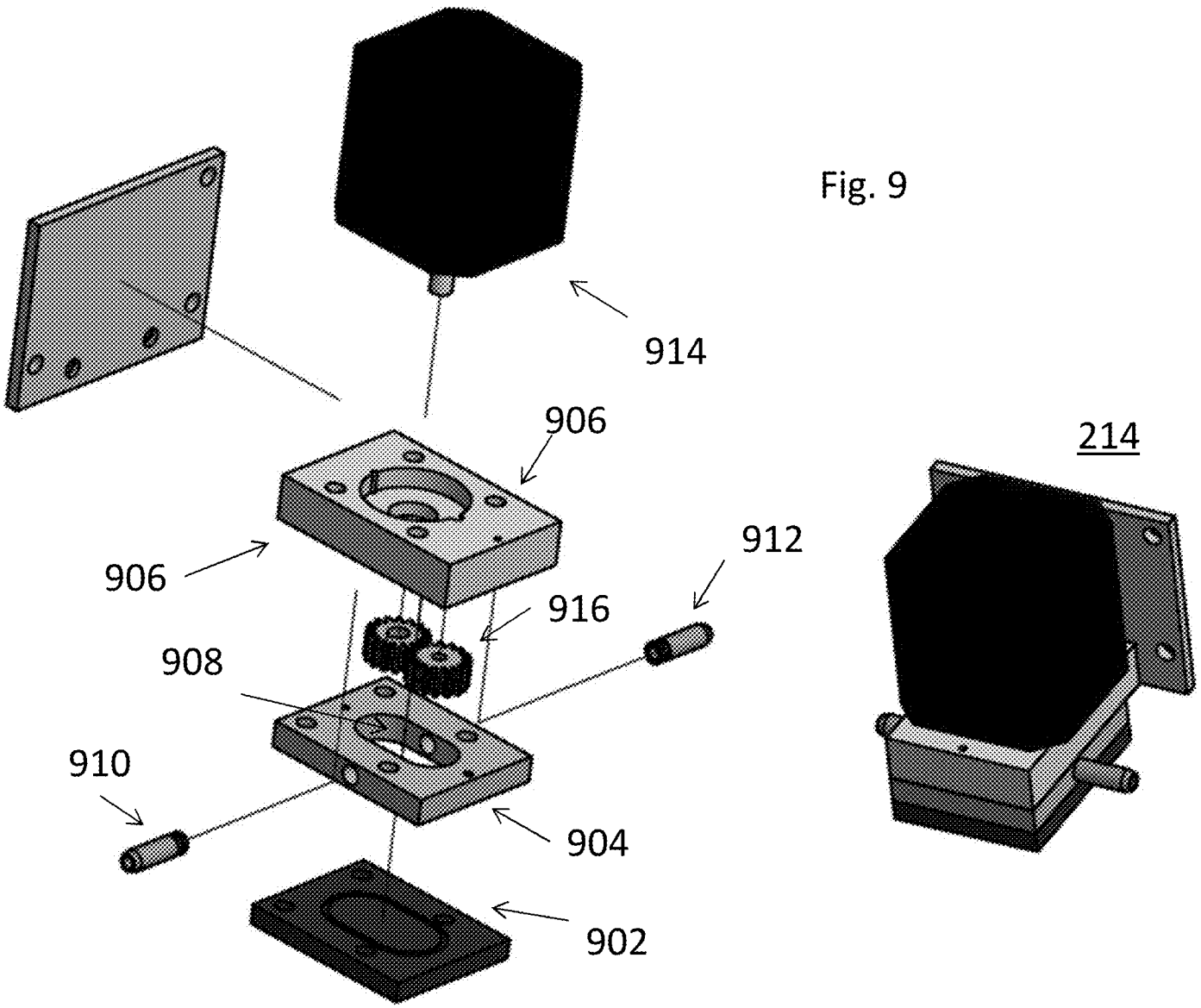
FIG. 9 shows the fuel metered pump of FIG. 2.

Referring now to FIG. 9, fuel pump 214 is shown in more detail. A bottom base plate 902, a support plate 904 and a top plate 906 define an inner chamber 908 with fluid inlet and outlet pathways 910 and 912. A DC motor 914 drives gears 916 within inner chamber 908 to draw fluid from fuel reservoir 208 to atomizing chamber 408. However, the invention is not so limited, and other forms of fuel pumps may be used.

Figure 10:
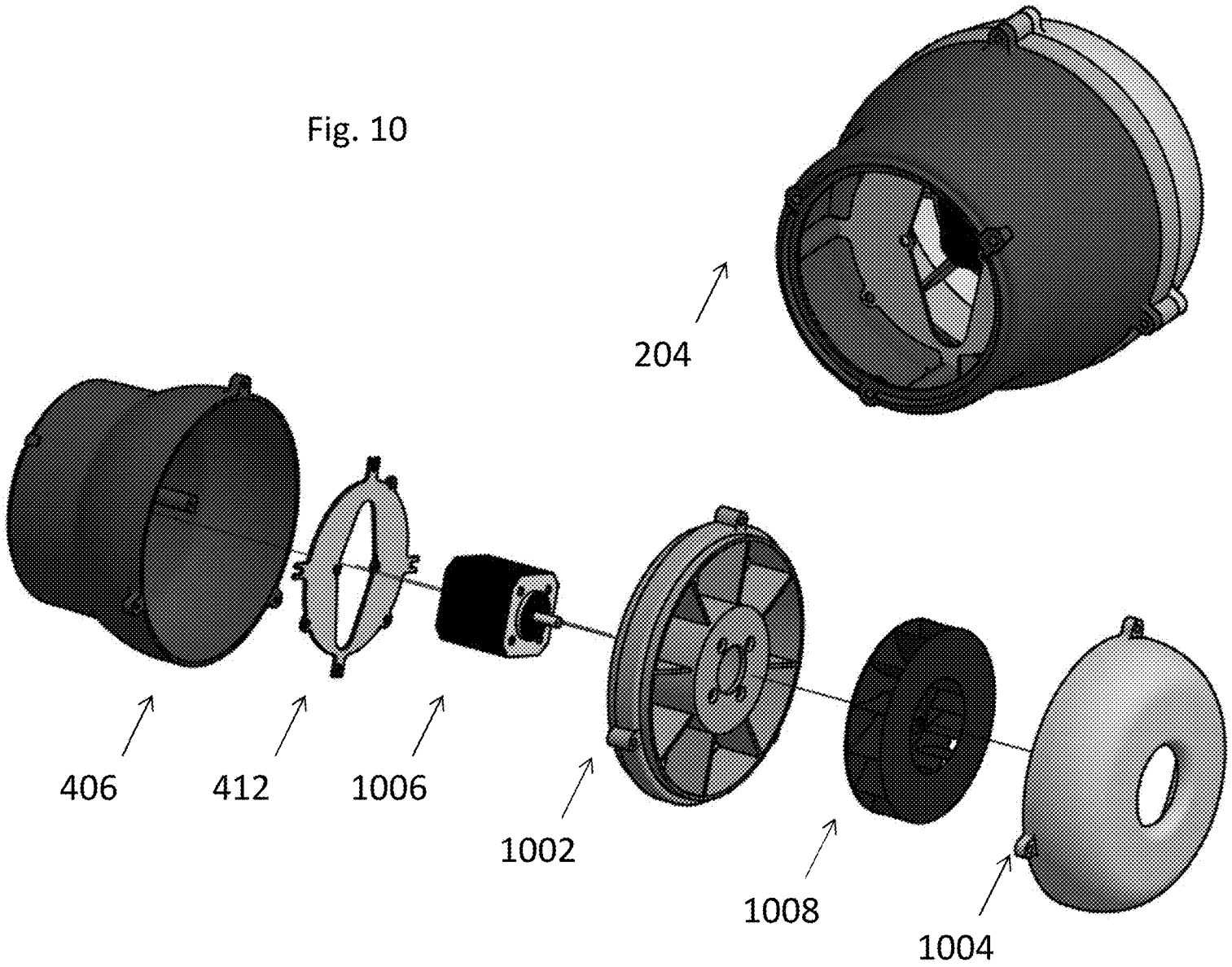
FIG. 10 shows the blower of FIG. 2.
Figure 11:
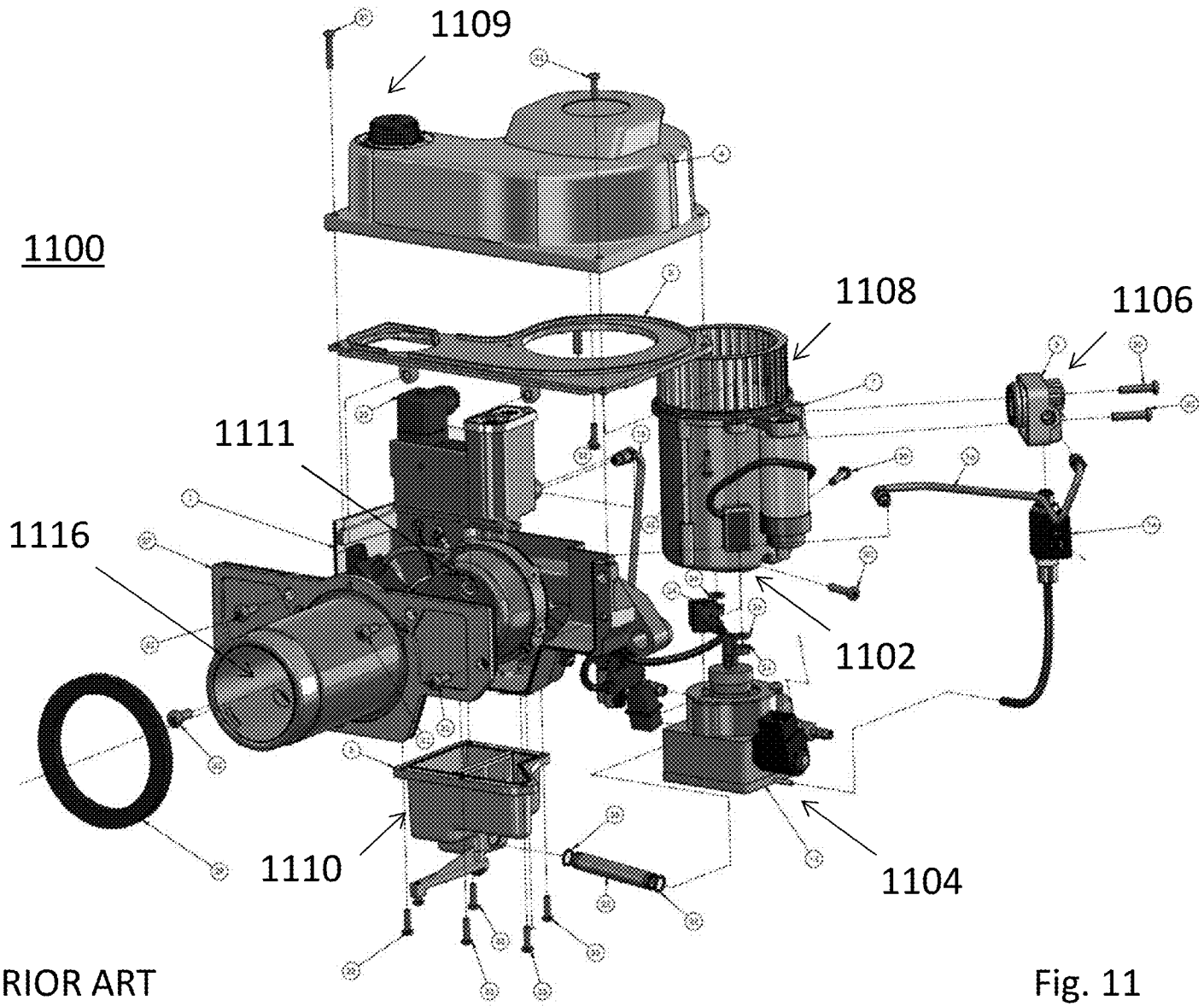
Fig. 11 PRIOR ART
FIG. 11 shows a prior art blower.

Referring now to FIG. 10, blower 204 is shown in more detail. The outer shell is defined by front casing 406, and intermediate support 1002, and rear casing 1004. A DC motor 1006 drives a blower wheel 1008 to draw air through an opening in rear casing 1004 and blows it out front casing 406 into the space between inner and outer tubes 402 and 404 as discussed above. Intermediate support provides a mounting point for both motor 1006 and blower wheel 1008.

The above embodiment combusts fuel in a manner consistent with the Babington atomization principle. Fuel pump 214 delivers fuel over the atomizing heads 416. Atomizing air pump 212 pumps air through holes in the atomizing heads, spraying the delivered fuel into the inner flame tube 404. Blower 204 delivers combustion air into the inner flame tube 404 to facilitate combustion of the fuel. Ignition transformer 210 ignites the fuel spray to induce combustion.

Microcomputer 206 is connected to the three DC flow motors 802, 914, and 1006. As DC motors, their speed is adjustable to adjust the flow rates of fuel, atomizing air and combustion air. Microcomputer 206 can thus control the speeds of the three flow parameters that define how much heat burner 200 produces, such as by controlling the amount of voltage applied or rate of pulsing of the motors. The invention is not limited to the manner in which the microcomputer 206 controls the speed of the DC motors.

As noted above, in an atomization burner the flow of compressed air, combustion air and fuel must maintain a certain relationship in order to properly combust the fuel. Microcomputer 112 is accordingly programmed with protocols to set those three flow parameters to meet the desired goal of the system, which may be a target operating temperature of an appliance (e.g., 350 degrees) or certain heat output (e.g., low, medium, high and gradations there between). Preferably this is done algorithmically and/or through a database of parameters to meet the specific needs of the environment, such as the type of appliance, type of fuel, external temperature, presence of rain, etc. For example, the amount of heat needed to heat a stockpot cooker is different than to heat an oven, the latter being larger and traditionally operating at higher temperatures. Microcomputer could thus maintain one set of operating protocols for an oven, another for a stockpot cooker, etc.

The protocols could be specific, e.g., to reach a desired heat output set all three flow parameters to a certain value. The protocols may be adaptive, in that they are based on the current state of the burner relative to the target state; for example the flow parameters to heat an oven to 400 degrees from a starting state of room temperature may be different than if the starting state (or current state) of the oven is already at 300 degrees. The protocols may work on the "bang-bang" methodology, or may adjust the flow rates in response to current or predicted conditions to "soft land" at the target output to minimize overshoot. The protocols may call for certain flow parameters to use higher heat output under cold or rainy conditions or decrease heat output under hotter conditions. Other protocols may also be used. Protocols based on combinations of factors may also be used. The embodiments are not limited to the nature of the protocols used.

Microcomputer 206 can be programmed to implement specific turn ON and turn OFF protocols for the burner 200.

With respect to the ON protocol, the parameters for flow of atomizing air, combustion air and fuel may be different for ignition of the fuel as compared to running the blower. An ON protocol implemented by microcomputer 112 could thus be to set the flow parameters to a combination particular to ignition, detect the presence of flame via the flame detector, and then set the flow parameters to a combination particular to running the burner 200. Some or all of the parameters may be the same or different for ignition relative to running.

Figure 12:
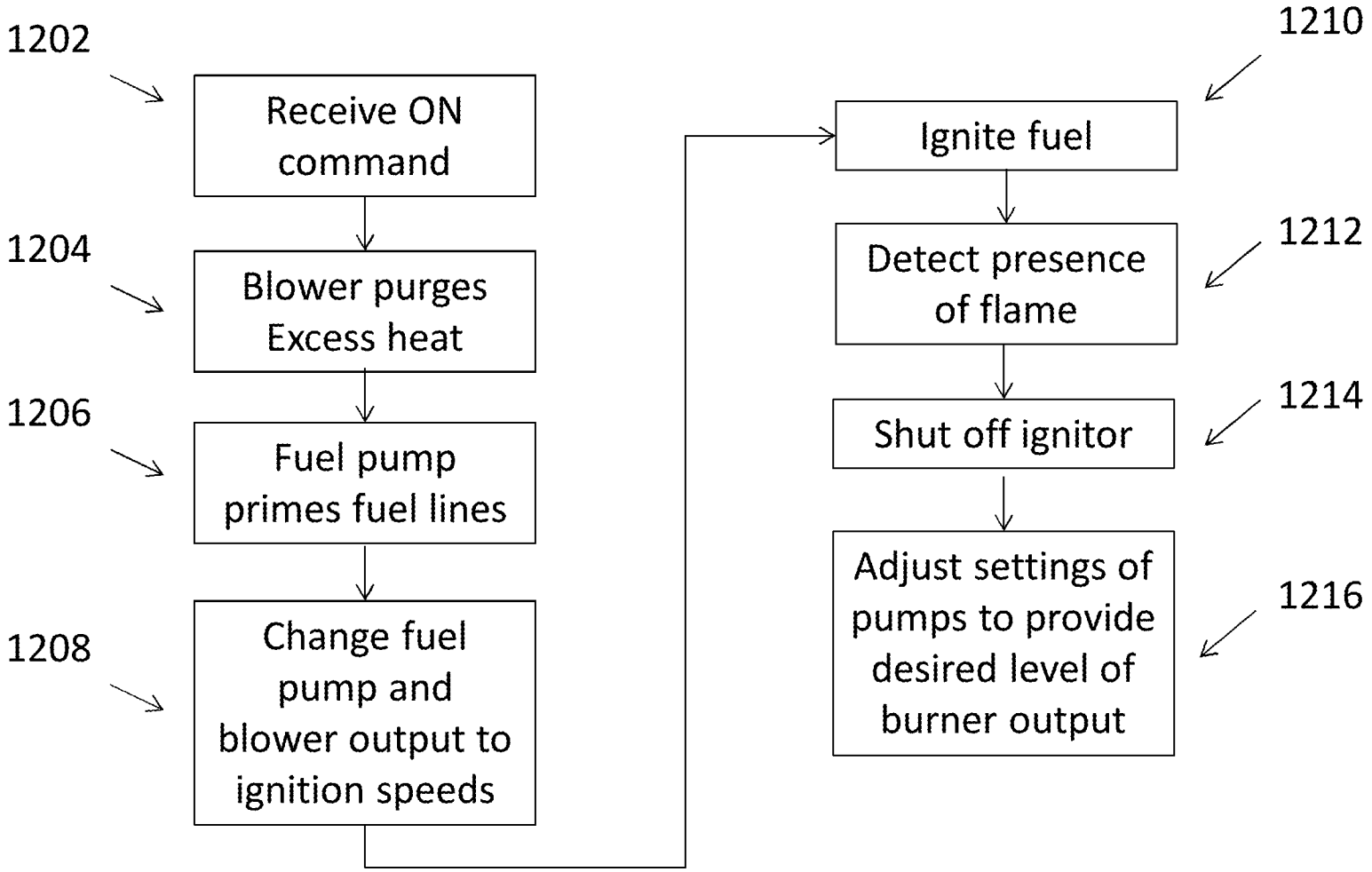
FIG. 12 is a flowchart of an embodiment of an OFF protocol.

A non-limiting example of an ON protocol with respect to burner 100 of FIG. 1 is shown in FIG. 12, as implemented by microcomputer 112 to adjust the speed of motors 110, 124 and 136. Beginning with an OFF state in which all motors are inactive, an ON command is received at step 1202. At step 1204 the blower purges any residual heat from burner 100, preferably by setting the motor 136 to its maximum speed (e.g., 6500 rpm) for a period of time (e.g., 30 seconds or until the ambient burner temperature drops below a certain value). After completion of step 1204 then at step 1206 the fuel pump 120 primes the fuel to the atomizing head 106, preferably by starting with a low speed of motor 124 (e.g., 600 rpm) increasing gradually to a fuel priming speed (e.g., 1200 rpm) and maintain the fuel priming speed for a period of time (e.g., 15 seconds); the objective is to drive all of the air out of the fuel lines and to adequately wet the atomizing head 106. At step 1208, the blower and fuel pump outputs are reduced to a speed to induce ignition (e.g., motor 124 to 400 rpm and motor 136 to 3500 rpm). After the burner reaches the new speeds, at step 1210 the fuel is ignited by turning on the ignitor and setting motor 112 of atomizing air compressor 102 to an ignition speed (e.g., 2200 rpm). At step 1212 the presence of flame is detected in the flame tube (e.g., through the methodology of U.S. patent application Ser. No. 15/153,98975, incorporated herein by reference in its entirety, although the invention is not so limited). In response to confirmation of flame the ignitor is shut off at step 1214, and at step 1216 the various flow parameters of burner 100 are changed to output the desired amount of heat.

With respect to a non-limiting example of an OFF protocol, flow parameters would continue (i.e., not be set to zero) but at least one of the flow parameters would be changed to preferably reduce the heat output, produce minimal pollution during the shutdown protocol, and impose minimal stress on the system. The change may increase or decrease the different flow parameters as needed to transition a shutdown transition state. After the transition state is reached the parameters are maintained for a first period of time to at least allow the transition state to stabilize. At the end of the first period of time the atomizing air and fuel flow would be stopped (e.g., by electric braking of the motors, and either simultaneously or in succession) while the flow of combustion air continues, possibly at different levels; the flow of combustion air is no longer for combustion purposes, but instead is preventing heat from building up in burner 200. After a second period of time, the combustion air flow is stopped (e.g., by electric breaking of the motor). The first and second times may be predetermined, or based on reaching detected target conditions. In addition and/or the alternative, the protocol may include reversing the flow of fuel (e.g., via reverse operation of motor 914) to clear the fuel lines.

Figure 13:
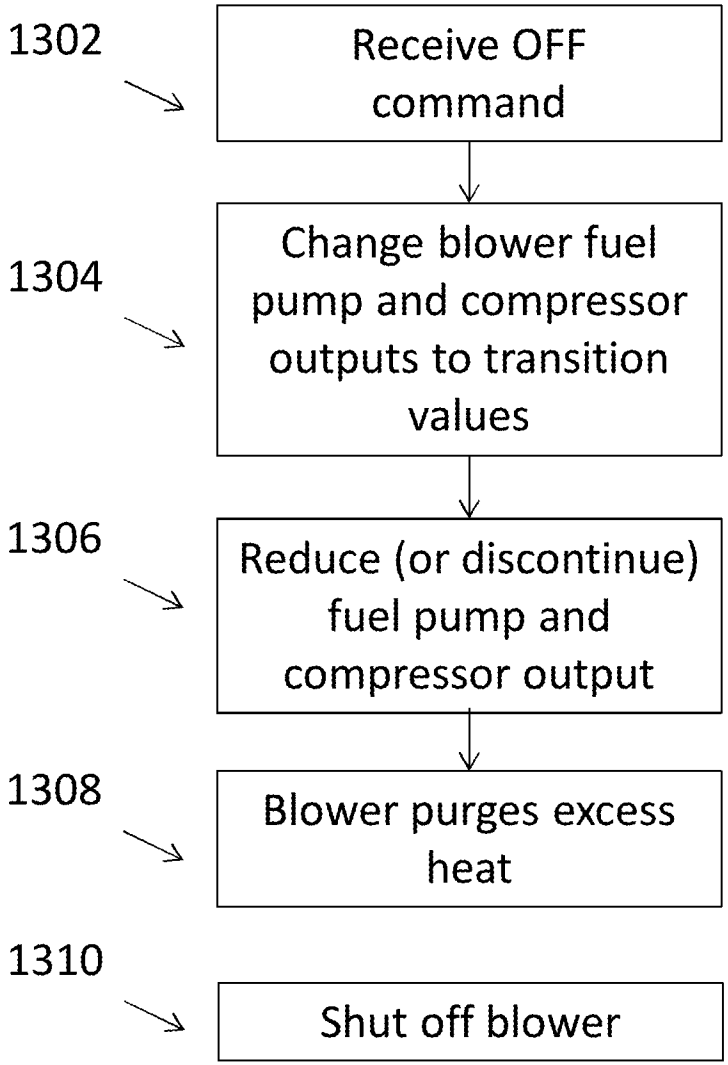
FIG. 13 is a flowchart for an embodiment of an ON protocol.

A non-limiting example of an OFF protocol with respect to burner 100 of FIG. 1 is shown in FIG. 13, as implemented by microcomputer 112 to adjust the speed of motors 110, 124 and 136. Beginning with an ON state in which all motors are active, an OFF command is received at step 1302. At step 1304 the speed of motors 110, 124 and 136 changes to predefined non-zero transition levels (e.g., 1200 rpm for the atomizing air pump 102, 300 rpm for the fuel pump 120, and 3000 rpm for the blower 132) and maintained for a period of time (e.g., 1-3 seconds) to allow burner 100 to stabilize. At step 1306, atomizing air pump 102 and fuel pump 120 reduce speed (e.g., discontinue of power flow or electric braking, such reduction preferably being to zero rpm to discontinue flow entirely); preferably the reduction is simultaneous, but it may be sequential. At step 1308, blower continues to operate to remove excess heat, preferably by increasing motor 136 to maximum (e.g., 6500 rpm) and maintaining air flow for a period of time (e.g., 2 minutes) or until the burner or appliance heated by the burner drops to a desired temperature 150F. When the target time/temperature is reached, at step 1310 blower 132 shuts down; air pump 102 and fuel pump 120 would also shut down at this point if they have not previously done so.

The above embodiments overcome various drawbacks over the prior art AIRTRONIC burner, particularly in connection with portable cooking appliances.

For example, the minimum fuel flow rate for burner 200 is about 0.155 GPH, which is on the order of 40% of the heat output and fuel consumed compared to the AIRTRONIC. The embodiments herein can thus generate less heat, and consume less fuel, than the AIRTRONIC. The embodiments also consume less power because unlike the AIRTRONIC the motors 802/914/1006 need not operate at maximum output. The current variable firing rate range of 0.155 GPH to 1.0 GPH far exceeds the operating ranges of the prior art AIRTRONIC burner.

Since the embodiments herein can generate less heat than the AIRTRONIC, it can be used with lighter/smaller cooking appliances, and/or enables off-grid self-powered capabilities. By way of non-limiting example, as discussed above an oven for use with the AIRTRONIC would be overbuilt to withstand the heat output and weighs on the order of 800 lbs., with a corresponding high specific heat that makes the oven slow to heat or cool. Embodiments herein can be used with an oven on the order of 200-250 lbs., which is cheaper to build, consumes less fuel to transport, easier to relocate on site, and can heat or cool much faster than its larger counterpart.

The embodiments herein can also operate without reliance on the "bang-bang" methodology, instead reducing the fuel flow rate as the target temperature is approached. This reduces the likelihood of overshooting the target temperature. Embodiments may precision load match the heat output of the burner with the load requirement of the appliance.

The embodiments herein also eliminate any need for a second blower in the appliance to prevent heat buildup. As noted above, when the AIRTRONIC is turned OFF, heat must be prevented from building up inside the flame tube; since the main blower is not active, a secondary blower is often present to provide venting air for 90-120 seconds. In the embodiments herein, blower 132 can continue to run during that period to provide the venting air. The embodiments herein thus remove any need for the secondary blower (although such a secondary blower may nonetheless still be present).

The embodiments herein are directed to use of burner with cooking appliances. However, the invention is not so limited, and other environments could be used.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A method for turning an atomizing burner from an ON state to an OFF state, the burner having independently controllable flows of atomizing air, combustion air, and fuel flow, the burner in the ON state having flow values of burner parameters including flow of atomizing air, flow of combustion air, and fuel flow, the method comprising:

changing, in response to an OFF instruction, flow of at least one of the flow of atomizing air, combustion air and/or fuel to a lower non-zero value;

first discontinuing, after a first period of time since the changing, flow of fuel and flow of atomizing air;

increasing, after a second period of time since the changing, flow of combustion air;

maintaining, for a third period of time since the increasing, flow of combustion air;

second discontinuing, after the maintaining, flow of combustion air;

wherein the maintaining prevents buildup of excess heat inside the burner during transition from ON to OFF.

2. The method of claim 1, wherein the first discontinuing discontinues flow of fuel and flow of atomizing air simultaneously.

3. The method of claim 1, wherein the first discontinuing comprises discontinuing one of flow of fuel and flow of atomizing air and then discontinuing the other of flow of fuel and flow of atomizing air.

4. The method of claim 1, wherein the first discontinuing comprises electrical braking of a motor driving flow of fuel and a motor driving flow of atomizing air.

5. The method of claim 1, wherein the combustion air is provided by a combustion air motor, and the increasing comprises setting the motor to its maximum output.

6. The method of claim 1, wherein the changing comprises changing, in response to an OFF instruction, flow the flow of atomizing air, combustion air and fuel to lower non-zero values.

7. The method of claim 1, wherein the changing comprises changing, in response to an OFF instruction, flow the flow of atomizing air to a lower non-zero value.

8. An atomizing burner having an atomizing head and a flame tube, comprising:

a first DC fuel motor adapted to deliver fuel flow to the atomizing head;

a second DC atomizing air motor adapted to provide to an opening in the atomizing head where the atomizing air will atomize the fuel;

a third DC combustion air motor adapted to deliver combustion air to the flame tube to aid in combustion of atomized fuel;

a controller comprising a combination of hardware and software programmed to turn the burner ON and OFF, wherein to turn a burner OFF by controlling the fuel motor, the atomizing air motor and the combustion air motor to perform operations comprising:

changing, in response to an OFF instruction, flow of at least one of flow of atomizing air, combustion air and/or fuel to a lower non-zero value;

first discontinuing, after a first period of time since the changing, flow of fuel and flow of atomizing air;

increasing, after a second period of time since the changing, flow of combustion air;

maintaining, for a third period of time since the increasing, flow of combustion air;

second discontinuing, after the maintaining, flow of combustion air;

wherein the maintaining prevents buildup of excess heat inside the burner during the transition to from ON to OFF.

9. The burner of claim 8, wherein the first discontinuing discontinues flow of fuel and flow of atomizing air simultaneously.

10. The burner of claim 8, wherein the first discontinuing comprises discontinuing one of flow of fuel and flow of atomizing air and then discontinuing the other of flow of fuel and flow of atomizing air.

11. The burner of claim 8, wherein the first discontinuing comprises electrical braking of a motor driving flow of fuel and a motor driving flow of atomizing air.

12. The atomizing burner of claim 8, wherein the increasing comprises setting the third DC combustion air motor to its maximum output.

13. The atomizing burner of claim 8, wherein the changing comprises changing, in response to an OFF instruction, flow the flow of atomizing air, combustion air and fuel to lower non-zero values.

14. The atomizing burner of claim 8, wherein the changing comprises changing, in response to an OFF instruction, flow the flow of atomizing air to a lower non-zero value.

* * * * *